United States Patent [19]

Nelson et al.

[11] Patent Number: 4,659,305

[45] Date of Patent: Apr. 21, 1987

[54] FLUE GAS RECIRCULATION SYSTEM FOR FIRE TUBE BOILERS AND BURNER THEREFOR

[75] Inventors: Peter K. Nelson, Palmyra, Pa.; Elroy M. Rulseh, Milwaukee, Wis.

[73] Assignee: Aqua-Chem, Inc., Milwaukee, Wis.

[21] Appl. No.: 814,901

[22] Filed: Dec. 30, 1985

[51] Int. Cl.[4] ..... F23M 3/00

[52] U.S. Cl. ..... 431/9; 431/115

[58] Field of Search ..... 431/9, 115, 116

[56] References Cited

U.S. PATENT DOCUMENTS

| | | | |
|---|---|---|---|
| 964,031 | 7/1910 | Leahy . | |
| 2,110,209 | 3/1938 | Engels . | |
| 2,174,663 | 10/1939 | Keller . | |
| 2,430,101 | 11/1947 | Campbell, Jr. et al. . | |
| 2,532,214 | 11/1950 | Willenborg | 431/115 |
| 3,146,821 | 9/1964 | Wuetig | 431/115 |
| 3,369,587 | 2/1968 | Taubmann | 431/115 |
| 3,741,166 | 6/1973 | Bailey . | |
| 3,868,211 | 2/1975 | La Haye et al. | 431/115 |
| 4,483,832 | 11/1984 | Schirmer | 431/116 |
| 4,519,773 | 5/1985 | Parish et al. . | |

*Primary Examiner*—Carroll B. Dority, Jr.
*Attorney, Agent, or Firm*—John C. Cooper, III; Fred Wiviott

[57] ABSTRACT

A flue gas recirculation system for fire tube boilers includes a duct connected to the boiler gas discharge stack and to a fan. Another duct couples the fan to a specially designed burner in the boiler. Recirculated flue gas is injected downstream of the fuel/air mixture in the burner and cools the flame leading to substantially reduce the $NO_x$ content in the boiler stack emissions. The burner includes conventional damper and air diffuser systems and a plurality of openings near the inner end of the burner housing, through which the boiler fuel is admitted and mixed with the air. A plurality of slots are formed at the outlet end of the burner, the slots being coupled to an annular chamber surrounding the burner. The duct from the recirculation fan is coupled to such annular chamber. Recirculation of between about fifteen to twenty percent of the flue gas in the above-described device can result in $NO_x$ reductions of more than sixty percent, when compared to a similar boiler operating without such flue gas recirculation.

11 Claims, 5 Drawing Figures

FLUE GAS RECIRCULATION SYSTEM FOR FIRE TUBE BOILERS AND BURNER THEREFOR

BACKGROUND OF THE INVENTION

1. Field of the Invention

The present invention relates generally to the art of fire tube boilers and more particularly to a fire tube boiler system which includes a specially designed burner and a duct and fan system for recirculating a minor portion of the flue gas to the burner. Still more specifically, the present invention relates to a fire tube boiler having substantially reduced $NO_x$ emissions.

2. Description of the Prior Art

The concept of flue gas recirculation to reduce $NO_x$ emissions has been known for many years, but to the knowledge of the present inventors, this concept has only been successfully applied to $NO_x$ pollution control in water tube boilers. In such prior art flue gas recirculation systems, a duct is typically connected to the flue stack and to a small recirculation fan. Another duct is coupled to the fan and to the combustion air inlet of the burner of the boiler. Only in recent years has the technology been employed with packaged boilers, mainly because of changes in state and local emission limits, principally in the State of California.

Depending on the type of fuel which is being burned, two types of nitrogen oxides can be formed. Fuel bound $NO_x$ is formed as a result of nitrogen being present in the fuel itself, e.g., in fuel oils. During combustion, the nitrogen is released and quickly reacts with the oxygen in the combustion air to form $NO_x$. The reactions to produce fuel bound $NO_x$ are not particularly temperature-dependent. Thermal $NO_x$ is formed, on the other hand, when high combustion temperatures break down the nitrogen gas in the combustion supporting air to atomic nitrogen. When this occurs, the atomic nitrogen will very quickly react with oxygen to form thermal $NO_x$.

If natural gas is employed as the boiler fuel, only thermal $NO_x$ is formed, because clean natural gas does not contain any nitrogen containing compounds. On the other hand, both thermal and fuel bound NO are formed when burning fuel oils. Moreover, the amount of fuel bound NO production in fuel oil combustion will depend on the quality of the oil. No. 6 oil, for example, will produce a considerably greater amount of fuel bound $NO_x$ than will No. 2 oil, because the former contains a greater quantity of fuel bound nitrogen.

It is also generally known that by cooling the combustion flame temperature, $NO_x$ production can be decreased. From the foregoing description, it is apparent that the effect of flame temperature reduction will be greatest when thermal $NO_x$ production is involved and will be less effective in reducing fuel bound $NO_x$ production. It follows then that flame temperature reduction by the recirculation of stack gas is most effective when the boiler is burning natural gas.

While $NO_x$ reduction in water tube package boilers has been successfully accomplished prior to the present invention, optimization of flue gas recirculation for fire tube boilers has been difficult. The technical problems with the two kinds of boilers result from the differences in the amount of combustion air which must be injected, and differences in pressure drops at various locations in the systems. Much higher combustion air injection pressures are required with fire tube boilers because the combustion gases flowing through the boiler must pass through the constricted area of the fire tubes. For example, with fire tube boilers, pressure losses of 15 inches or more are common, while with water tube boilers, the pressure drops encountered are typically 8 inches or less. Greater recirculation rates are required for firetube boilers in comparison to watertube boilers to obtain the same percentages of $NO_x$ reduction. This results because the combustion chamber for the firetube boiler is a narrow tube compared to the large volume chamber of the watertube boiler. This results in shorter residence time for the flue gases in firetube furnaces.

Several patents are known to the present inventors which relate generally to the subject of flue gas recirculation. In Leahy's U.S. Pat. No. 964,031, issued July 12, 1910 for "Liquid Hydrocarbon Burning Apparatus," a fire tube boiler is described, in which a portion of the combustion gas is directed from the exit of the combustion tubes to the burner area. Control of the amount of recirculated gas is provided by a damper at the exhaust stack, by a pair of dampers at the inlet side of the burner (to control injection through a plurality of orifices spaced along the combustion housing, and by control of the space which exists between the burner and the combustion housing). Leahy relates specifically to the burning of fuel oils and the recirculation of partially consumed combustion products to increase the efficiency of combustion. This patent does not teach or suggest the reduction of $NO_x$ by flue gas recirculation, the advantages thereof in reducing thermal $NO_x$ formation, the combustion device of the present invention, or any of the specific apparatus or controls used therewith. Moreover, since modern package boilers typically have extremely high combustion efficiencies, one skilled in the art would not look to Leahy as a patent of interest for $NO_x$ reduction.

In Engels' U.S. Pat. No. 2,110,209 issued Mar. 8, 1938 for "Furnace," the invention relates to protection of the costly combustion chamber by providing a blanket of cooler gas, for example recirculated flue gas, along the wall of the combustion chamber by injecting a flow of such cooler gas through a plurality of openings at the inlet to the chamber. The patent does not teach or suggest the use of recirculated flue gas to reduce $NO_x$ levels or the specific burner configuration of the present invention or the control systems used therewith. An external duct and a special fan are provided for the injection and proper mixing of the recirculated flue gas, which in turn, reduces $NO_x$ production.

Another system which employs recirculated flue gas is that described in Keller's U.S. Pat. No. 2,174,663 issued Oct. 3, 1939 for "Tubular Gas Heater." This system includes heat exchanger tubes which are traversed by gases to be heated, and in which preheated air is used for combustion. To prevent unduly high heating of the heat exchanger tubes, flue gases are recirculated in two paths, one flowing along those heat exchanger tubes in which adjoin the furnace wall, and another flow path which is introduced directly above the flame (the combustion chamber being oriented vertically). Apertures are provided to control the amount of recirculated gas passing in the two flow paths, the apertures being provided in a partition surrounding the combustion chamber. As previously mentioned, the patent relates to prevention of undue heating of heat exchange tubes, rather than $NO_x$ reduction, and the combustion device of the present invention and the controls used therewith are not disclosed or suggested in this patent.

Recirculated combustion gases are also utilized in Campbell's U.S. Pat. No. 2,430,101 issued Nov. 4, 1947 for "Combustion Chamber." The device described here is used in the baking industry. Recirculated exhaust gases are passed from an external duct into a casing surrounding the combustion chamber to reduce its temperature and to pick up heat therefrom. The recirculated gas then combines with the combustion gas at the outlet of the combustion chamber and flows through a radiator system used to warm the baking space. The patent does not suggest the case of recirculated flue gas for $NO_x$ reduction or the round combustion apparatus of the present invention.

Bailey discloses another recirculation system in his U.S. Pat. No. 3,741,166 issued June 26, 1973 for "Blue Flame Retention Gun Burners and Heat Exchanger Systems." In this system, a low pressure area is created by the vigorous injection of a major portion of the combustion supporting air through a vitiation zone positioned upstream of the fuel injection region. The low pressure area causes a portion of the combustion gases to be recirculated to chemically alter the combustion air before it encounters the fuel spray. The gases are cooled to below 800 F. before entering the vitiation zone. The remainder of the combustion air is injected through a plurality of diverging jets aimed toward the combustion chamber and is used to cool the fuel nozzle. The patent indicates that the system reduces localized hot spots which augment $NO_x$ production. This patent does not disclose the recirculation of flue gas or the use of the novel combustion apparatus of the present invention.

In commonly-assigned U.S. Pat. No. 4,519,773 issued on May 28, 1985 to Mark G. Parish, et al. for "Dual Cannister Gas Housing," a combustion apparatus is disclosed which may be employed for the introduction of two different fuel gases into a combustion chamber, the fuel gases having different fuel values. For example, the disclosed dual cannister housing could be used with natural gas, land fill gas, etc. Depending on the quantities and/or costs of the respective gases at any particular time, the gases can be supplied one at a time or mixed in the device of this patent to provide economical and efficient combustion. The aforementioned patent does not disclose flue gas recirculation, and in fact, teaches away from using a dual cannister concept for flue gas recirculation since both gases used in the patent have significant fuel values. As previously mentioned, modern boiler technology has led to efficiency improvement to the point that there is little, if any, fuel value in the exhaust gases. This is especially true for those modern boiler designs which include control systems for regulating fuel and air supply during start-up and operation under varying conditions.

An improved flue gas recirculation system for fire tube boilers which would provide substantial $NO_x$ reduction and which could be employed with new boilers or be added to existing boilers, would represent a substantial advance in the art.

OBJECTS AND SUMMARY OF THE INVENTION

It is a primary object of the present invention to provide a flue gas recirculation system for fire tube boilers which includes a novel burner and which leads to substantial $NO_x$ reduction.

Another object of the present invention to provide a $NO_x$ reduction system and novel burner arrangement which can be incorporated into new boilers or can be added to existing units.

A further object of the present invention is to provide a burner for fire tube boilers which is designed to inject cooling recirculated flue gas at the outlet of the burner.

A different object of the present invention is to provide control systems for the flue gas recirculation system which will cooperate with convention boiler air and fuel controls to optimize the efficiency of the flue gas recirculation $NO_x$ reduction system of the present invention.

A still further object of the present invention is to provide a $NO_x$ reduction system which will allow boiler installations to meet increasingly stringent air quality emission limitations.

How these and other objects of the invention are accomplished will be described in the following detailed description of the preferred embodiment, taken in conjunction with the drawings. Generally, however, they are accomplished by providing an outlet duct from the stack of a fire tube boiler, through which flue gases can be recirculated. The fan inlet is coupled to this duct and the fan outlet is coupled to a second duct which is connect to the burner assembly of the boiler. Controls are provided so that an appropriate percentage of the flue gas will be recirculated. The preferred system includes standard control systems for regulating the fuel and combustion air delivered to the boiler, and diffusers for imparting the desired flow to the incoming combustion air. Inlets for the recirculated flue gas comprise slots located in the forward end of the burner assembly, the slots being coupled to an annular chamber surrounding the burner. Such chamber is also coupled to the second flue gas recirculation duct which has been previously mentioned. Using the system of the present invention, it has been found that large quantities of recirculated flue gas can be accomplished with small fan requirements and large reductions in $NO_x$. Other ways in which the objects of the invention are accomplished will become apparent to those skilled in the art after the present specifications have been read and understood.

In the various drawings, like reference numberals are used to illustrate like components.

DETAILED DESCRIPTION OF THE PREFERRED EMBODIMENT

Figure 1:
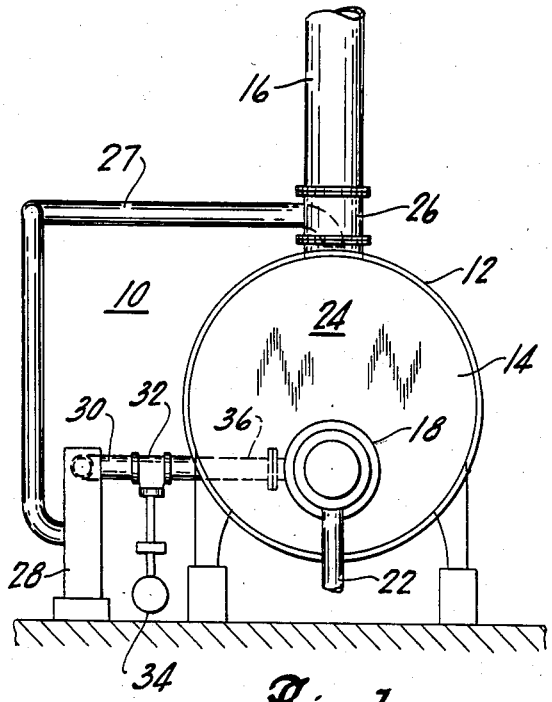
FIG. 1 is a schematic end view of a boiler and a flue gas recirculation system according to the preferred embodiment of the present invention.
Figure 2:
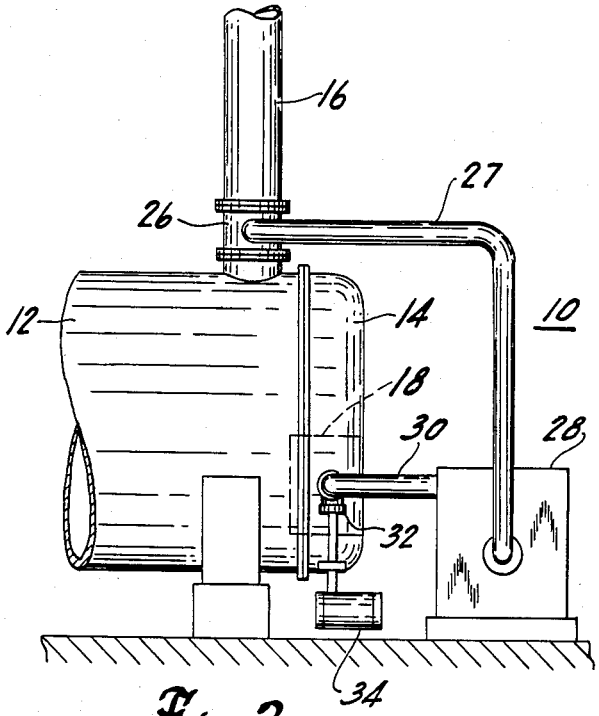
FIG. 2 is a schematic side view of the boiler and flue gas recirculation system shown in FIG. 1.

A shcematic illustration of the system according to the preferred embodiment of the present invention is shown in FIGS. 1 and 2. Before proceeding to the description of those Figures, it should be explained that the particular type shape of boiler is not critical to the present invention, and that numerous conventional devices commonly employed with regular or packaged boilers are not shown (so that the feature of the present invention can be better appreciated). For example, the air injection fan, trim systems for controlling air and fuel ratios and pressures, sensors for determining boiler operating conditions, ignitors, etc., are not shown, but they would be used in a boiler installation employing the principles of the present invention.

A fire tube boiler flue gas recirculation system 10 is shown in FIGS. 1 and 2 to include a generally cylindrical boiler 12 having a generally circular end wall 14. A stack 16 is provided at the top of boiler 12 for the combustion exhaust. In the illustrated embodiment, a burner 18 is provided in end wall 14 and fuel supply pipe 22 is shown coupled thereto at FIG. 1. It should also be appreciated that an air fan will be located in the vicinity of the numerical 24 and that suitable duct work and controls (not shown) will connect the fan to burner 18.

A first duct 27 (which may be insulated) is coupled to a vent stub adapter 26. The adapter 26 is provided to take advantage of the flue gas velocities traveling upwardly in stack 16. Such velocities will be used in system 10 to minimize inlet pressure drops in the inlet to duct 27, thereby minimizing the required static pressure. The other end of duct 27 is coupled to the inlet of a recirculation fan 28 which may be selected from any number of known fans, but which must be sized properly for the particular flue gas recirculation job to be accomplished.

The sizing of the fan 28 will involve three major factors. The first is the percentage of flue gas to be recirculated, which in turn determines the quantity of gas which needs to be moved. The percentage affects not only the quantity (i.e., CFM), but also the static pressure. Ihe more recirculated flue gas required, the greater the static pressure requirement also.

The second factor which will affect the size of fan 28 is the location where the recirculated flue gases re-enter the system. This also results from the differences in the static pressure which will result as the inlet location is varied. For example, if the flue gases were to be introduced at the combustion fan outlet, the static pressure requirement for fan 28 could be nearly four times greater than if the flue gases were introduced at the outlet end of burner 18.

Finally, stack temperature also affects the sizing of the fan because it will change both the flow rate of gases in terms of the cubic feet per minute required and the cold static pressure requirements. It will be apparent therefore, that both the size of the fan and the fan motor horsepower requirements depend on overall system size and design.

An outlet duct 30 is coupled to the outlet side of fan 28 and to a flow control valve 32. Valve 32 will be used for two purposes, i.e., control of the amount of recirculated gas admitted to system 10 and more importantly, for safety purposes dictated by the high temperatures and pressures involved with our flue gas recirculation system. In the illustrated embodiment, the flow control valve is activated by a pneumatic actuator 34 to insure positive shut-off of gases flowing through duct 30. Accordingly, valve 32 has the dual capacities of flow control and shut-off.

One example of when shut-off would be required is during boiler start-up when flue gas recirculation is not employed. Using a signal generated from the jackshaft (not shown) of the boiler, valve 32 can be used to control the flow of recirculated flue gas at a given percentage throughout the firing range of the boiler after start-up and a warming period have been achieved.

Several safety features which are not directly related to the present invention should be mentioned here, even though they have been designed into the commercial embodiment of our assignee's system. First, the flue gas recirculation system is not allowed to operate until the boiler warms up to a predetermined temperature and reaches operating status. The system to accomplish this result is similar to those conventional systems used for low fire hold control, where boiler water temperatures will determine proper operating conditions. This feature will prevent a potentially dangerous condition which would occur if excessively high recirculation ratios were employed in a cold boiler.

Another safety feature provided in the commercial embodiment is a differential pressure switch installed across the fan to insure that the fan 28 is operating properly. This feature prevents hot gases from the boiler from reversing through the fan and insures that the fan is actually creating flow in the proper direction. If, for any reason, the pressure differential required by the switch is not met, the control valve 32 will shut tight and an alarm will sound after the flue gas recirculation system has been deactivated.

Finally, the aforementioned signal obtained from the boiler jackshaft is compared to the actual position of the control valve 32 by a comparator means. If, for any reason, these two valves do not match within certain limits, improper recirculation is occuring and the flue gas recirculation system will be shut down, thus preventing the potentially serious problem of high levels of recirculated gas. Such high levels can, of course, cause flame instability and/or loss of the flame.

Located downstream of the valve 32 is another duct 36 leading to burner 18. Housing 18 will now be described in connection with FIG. 3. In some respects, the generally cylindrical burner 18 resembles the dual cannister housing of the aforementioned Parish, et al. patent, but it is also different in a number of respects. Burner 18 is mounted to the boiler 12 in such a manner that its circular outlet end generally mates with a circular inlet to the boiler combustion chamber 43, the combustion chamber being surrounded by throat tiles 45 as is well known in the art.

Burner 18 includes a first generally cylindrical housing 47, the axis of which is generally coaxial with the opening 41 to chamber 43. A pipe 49 is located at the axis of housing 47 and is used to supply fuel oil to boiler 12 through nozzle 51 attached to the outlet end of pipe 49. Pipe 49 would only be employed if the burner 18 were to be used for alternate fuels, such as fuel oil and natural gas. It will be appreciated by those skilled in the burner art that combustion air is introduced in the space 50 between housing 47 and pipe 49.

A burner diffuser 52 and an air straightener 54 are located housing 47 in surrounding relation to pipe 49 and are known components for burners used with boilers. In and of themselves, they do not form part of the present invention. The diffuser 52 and straightener 54 are employed to produce proper air flow into the combustion chamber 43, but it should be noted that a substantial pressure drop does occur across the diffuser, e.g., a fifty percent pressure drop.

A second housing 56 is located about housing 47 and is spaced therefrom to form an annular chamber 57. An inlet pipe 59 is coupled to chamber 57 and is used to introduce a fuel gas, for example, natural gas, thereto. Chamber 57 is also coupled to space 50 by a plurality of inlet nozzles 58 which are provided in the wall of housing 47 downstream of air diffuser 54. The nozzles 58 may be either holes in the wall of housing 47 or small inlet pipes (not shown) mounted to holes in the wall of housing 47.

A third housing 60 is located in surrounding and spacedapart relationship to housing 56, forming a chamber 61 therebetween. Duct 36 is coupled to a duct 63 which enters space 61 and allows recirculated flue gas to be introduced to burner 18. Space 61 is coupled to burner chamber 43 through an annular radial passageway 65 which extends downwardly toward space 50 and around the inner end of housing 56. Passage 65 opens at the outlet end of burner 18 in a plurality of slots 67 spaced apart from and downstream of the gas nozzles 58. From this description then, it will be apparent that the flue gas outlets 67 are downstream of the fuel supply inlet, whether natural gas or fuel oil is being burned in burner 18.

Figure 3:
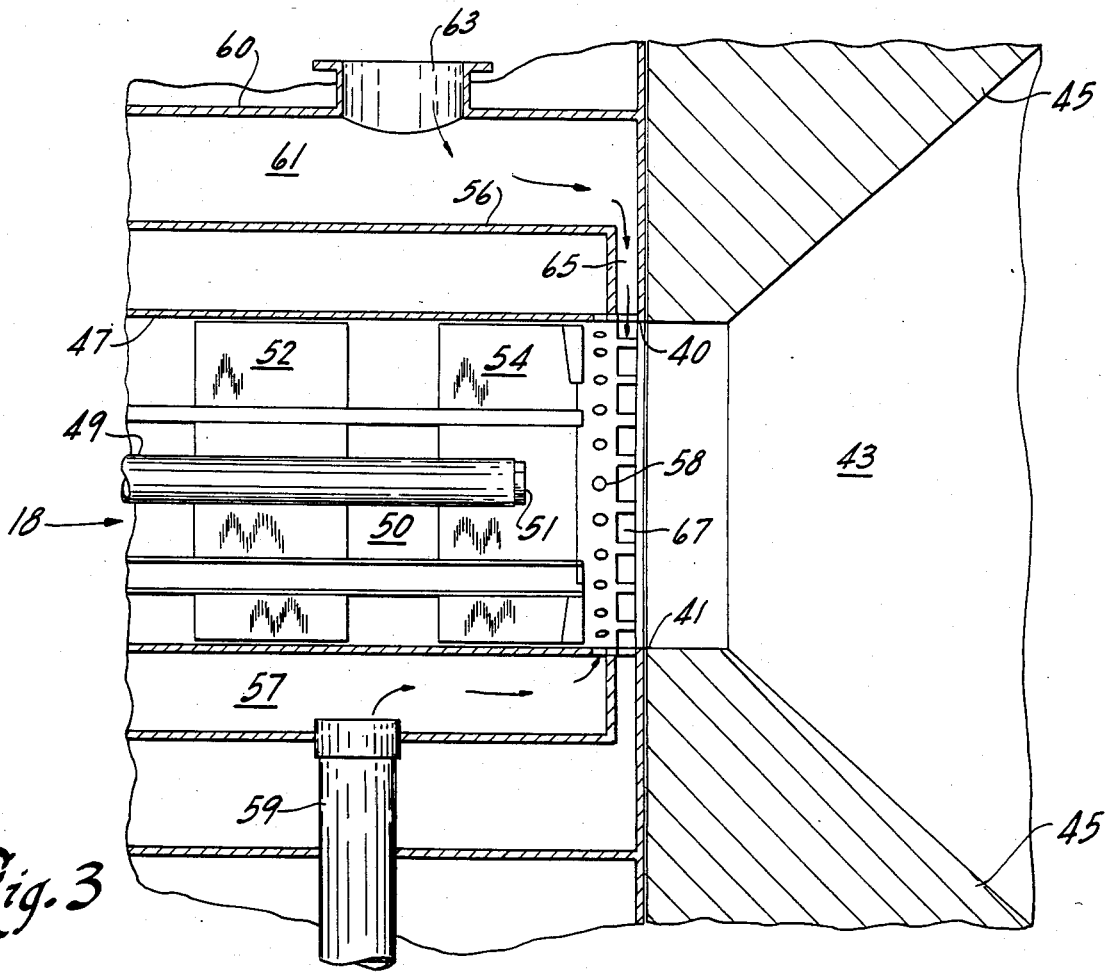
FIG. 3 is a cross-sectional side view of the burner assembly employed in the preferred embodiment of the present invention.

Use of the flue gas injection location depicted in FIG. 3 accomplishes two major improvements when compared to introducing the recirculated flue gas at the outlet for the combustion air or at any other location along the burner housing 47. First, introduction of the flue gases downstream of the combustion air diffuser and dampers allows the system to operate under much lower static pressure requirements than would otherwise be the case. This allows the use of a small recirculation fan with the resultant reduction in horsepower requirements. In practice, it has been found that as little as one-fourth the amount of horsepower is required for the burner of the present invention. Second, introduction of the flue gas as indicated in FIG. 3 will prevent condensation of water created during combustion in the burner. In addition to eliminating a system for draining water from the burner, corrosion caused by the water is eliminated thereby prolonging damper life and preventing binding thereof.

This advantage is even more pronounced if the boiler system 10 is burning a fuel which contains sulfur, as the sulfuric acid content of the water creates even greater corrosion problems.

The usefulness of the system of the present invention in reducing $NO_x$ formation is illustrated in the following Tables 1 and 2, which are grapically depicted in FIGS. 4 and 5.

TABLE 1

| | Natural Gas - Low Fire | | | | | | | |
|---|---|---|---|---|---|---|---|---|
| Percent $O_2$ | 2.6 | 2.6 | 2.6 | 2.5 | 4.2 | 3.8 | 3.6 | 4.6 |
| Actual NOx | 69 | 54 | 42 | 36 | 36 | 25 | 20 | 16 |
| Corrected NOx | 68 | 53 | 41 | 35 | 38 | 26 | 21 | 17 |
| Percent FGR | 0 | 8.0 | 13.3 | 16.5 | 16.1 | 21.7 | 25.4 | 29.6 |
| $NO_x$ Red. % | 0 | 22 | 40 | 49 | 44 | 62 | 69 | 75 |

| | Natural Gas - High Fire | | | | |
|---|---|---|---|---|---|
| Percent $O_2$ | 3.0 | 3.4 | 3.2 | 2.6 | 2.2 |
| Actual NOx | 94 | 83 | 68 | — | 41 |
| Corrected NOx | 94 | 85 | 69 | — | 43 |
| Percent FGR | 0 | 4.0 | 7.2 | 13.0 | 14.5 |
| $NO_x$ Red. % | 0 | 10 | 27 | — | 53 |

TABLE 2

| | No. 2 Oil | | | | | | | |
|---|---|---|---|---|---|---|---|---|
| Firing Rate | Low | Low | Low | Low | Low | High | High | High |
| Percent $O_2$ | 3.7 | 4.1 | 4.4 | 4.4 | 4.5 | 3.6 | 3.3 | 2.8 |

TABLE 2-continued

| | No. 2 Oil | | | | | | | |
|---|---|---|---|---|---|---|---|---|
| Actual NOx | 128 | 117 | 90 | 93 | 86 | 150 | 117 | 88 |
| Corrected NOx | 134 | 125 | 98 | 101 | 93 | 156 | 119 | 87 |
| Percent FGR | 0 | 7.4 | 15.6 | 15.6 | 18.2 | 0 | 7.1 | 15.4 |
| NOx Red. % | 0 | 7 | 27 | 25 | 31 | 0 | 24 | 44 |

Figure 4:
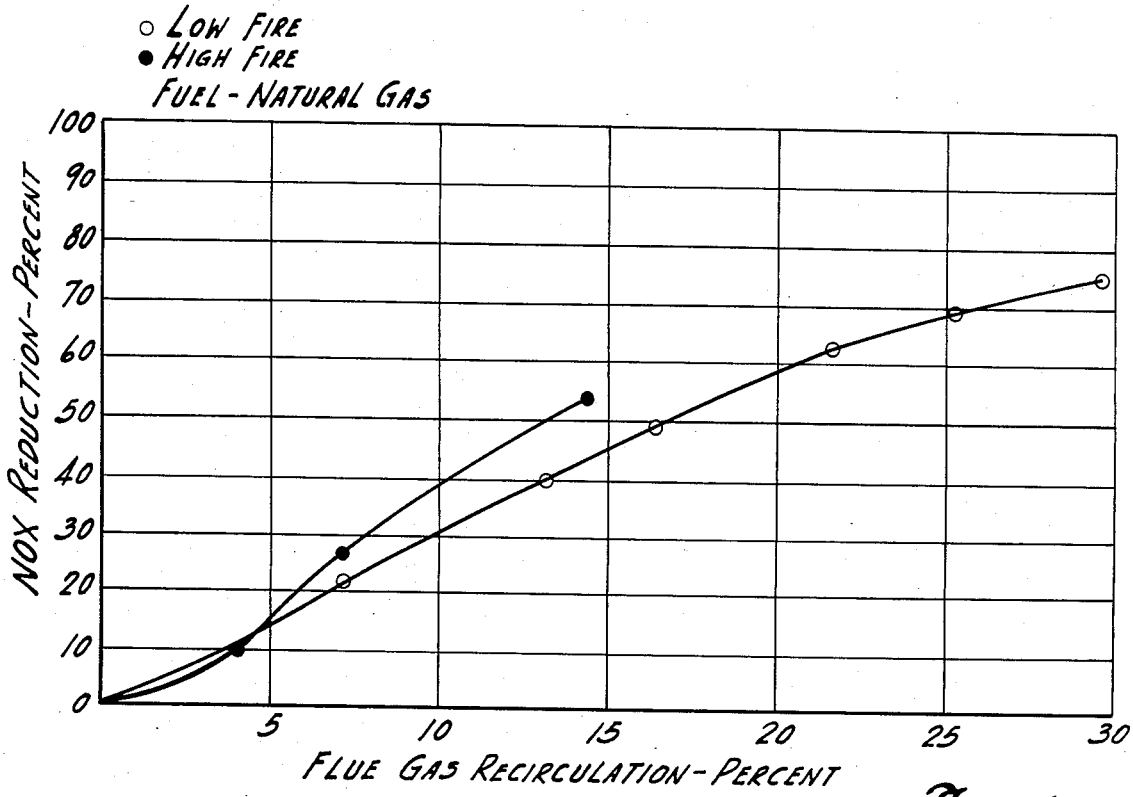
FIG. 4 is a graph showing the $NO_x$ reduction using the apparatus of the preferred embodiment of the present invention, with natural gas as the fuel and showing both high and low boiler fire conditions.
Figure 5:
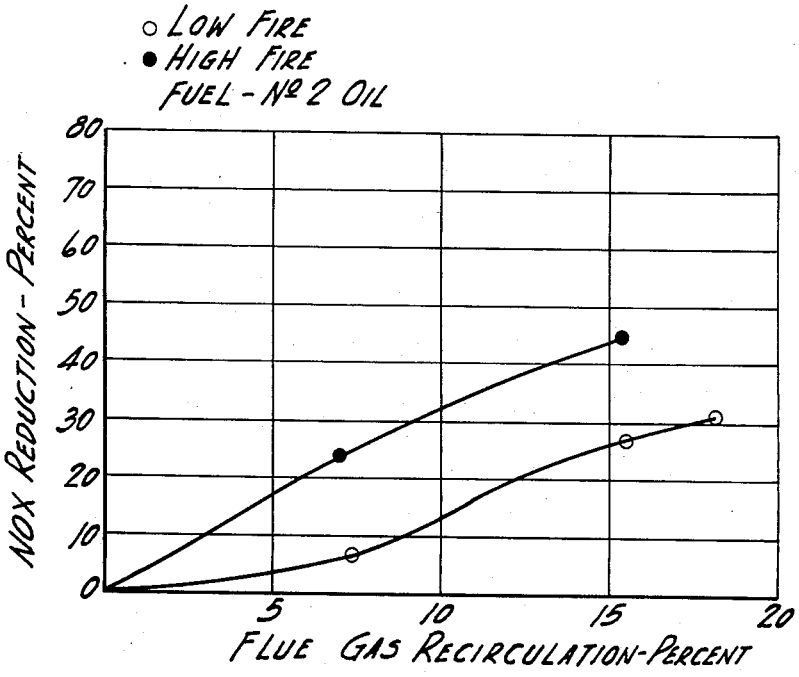
FIG. 5 is a graph showing the $NO_x$ reduction using the apparatus of the preferred embodiment of the present invention. Using No. 2 oil as the fuel and showing both high and low boiler fire conditions.

In Table 1 and FIG. 4, it has been demonstrated that $NO_x$ reductions as high as seventy-five precent can be accomplished by recirculating as little as thirty percent of the flue gas. However, more extensive testing has shown that approximately twenty percent recirculation is a more practical upper limit because the amount of $NO_x$ reduction begins to flatten out at that point. It is also demonstrated in the Tables and FIGS. 4 and 5 that $NO_x$ reduction by the system of the present invention is more successful in reducing thermal $NO_x$ than fuel bound by $NO_x$. For example, in FIG. 5, the $NO_x$ reduction is less than fifty percent, it being expected that a larger percent of the $NO_x$ in the combustion of No. 2 oil would be fuel bound rather than thermal.

The present invention then accomplishes the objects set forth above and overcomes the static pressure problems by introduction of the flue gas at the outlet of the burner. The flame produced by burner 18 is cooled to reduce thermal formation of $NO_x$ in a most advantageous fashion, with the temperature of the reinjected flue gas being approximately 350° F. in one prototype which has been tested.

While the present invention has been described in connection with a particular preferred embodiment, the invention is not to be limited thereby, but is to be limited solely by the scope of the claims which follow. One skilled in the art, after reading the present specification, could readily adapt the system of the present invention to boilers of different kinds and sizes, to boilers using different fuels, etc.

We claim:

1. A fire tube boiler system comprising a burner, a combustion chamber downstream of said burner and a burner housing, a series of fire tubes within said boiler, and an exhaust stack for the gases of combustion, said burner comprising means for injecting at least one fuel and combustion supporting air into said burner, the improvement comprising means for recirculating a minor portion of the gases of combustion, said recirculating means comprising duct means coupled to said stack and to a recirculation fan means, second duct means coupling said fan means to said burner and wherein said burner further includes outlet means for injecting said recirculated gases of combustion downstream of said fuel and combustion supporting air injecting means, wherein said burner housing comprises first and second cylindrical housings, wherein said first cylindrical housing has an outlet and means for injecting combustion supporting air axially therethrough, said fuel injecting means being located adjacent said combustion chamber but spaced inwardly of said cylindrical housing outlet, and said second cylindrical housing is surrounding and spaced apart from said first cylindrical housing, means for injecting a fuel gas into the space between said first and second housings, and a plurality of openings in said first housing for injecting said fuel into said burner.

2. The invention set forth in claim 1 wherein said openings comprise a plurality of holes in said first housing located adjacent to but spaced inwardly from the outlet of said first housing, but generally adjacent said combustion chamber.

3. The invention set forth in claim 1 wherein said burner housing further comprises a third cylindrical housing surrounding and spaced apart from said second cylindrical housing, means for injecting said recirculated gases of combustion into the space between said second and third cylindrical housings, outlet means for recirculated gases of combustion located adjacent the outlet of said first cylindrical housing and near said combustion chamber, and means for coupling said space between said second and third cylindrical housings to said outlet means without intermixing said recirculated gases of combustion and said fuel.

4. The invention set forth in claim 3 wherein said coupling means comprises an annular passage located adjacent the end of said burner housing located adjacent said combustion chamber.

5. The invention set forth in claim 3 wherein said outlet means comprise slot means.

6. The invention set forth in claim 5 wherein said slot means comprise a plurality of slots located about said first cylindrical housing.

7. A fire tube boiler comprising a burner, a combustion chamber, fire tubes, and a stack for exhaust flue gas, first duct means coupled to said stack, flue gas recirculation fan means having an inlet coupled to said first duct means, second duct means coupling the outlet of said fan means to said burner, said burner comprising a first cylindrical housing having an outlet end communicating with said combustion chamber, means for injecting combustion supporting air axially through said first cylindrical housing toward said combustion chamber, second cylindrical housing means surrounding and spaced apart from said first cylindrical housing, said second cylindrical housing having an end wall located inwardly of said outlet end of said first cylindrical housing, a plurality of openings in the first housing means located adjacent to and inwardly of said end wall, means for injecting a boiler fuel gas into the space between said first and second cylindrical housings, said burner further comprising a third cylindrical housing surrounding and spaced apart from said second cylindrical chamber, said third cylindrical housing having an end adjacent said combustion chamber, whereby a passageway is formed between said combustion chamber and the end wall of said second cylindrical housing, a plurality of slots in said first cylindrical housing coupling said passageway to the interior of said first cylindrical housing adjacent said combustion chamber and means coupling said second duct to the space between said second and third cylindrical housings.

8. The invention set forth in claim 7 wherein said boiler further includes flow regulating valve means in said second duct.

9. The invention set forth in claim 7 wherein said slot means comprise a plurality of slots spaced about said first cylindrical housing.

10. A method for reducing $NO_x$ emmissions from a fire tube boiler, including a burner in which a fuel is admixed with a preselected amount of combustion supporting air at a first location in said burner, said burner having a first annular housing surrounding said burner and a first spaced therebetween and a second annular housing surrounding said first annular housing and a second space therebetween, said method comprising the following steps:

removing a minor portion of the flue gas from a stack of the boiler;

directing said minor portion to an inlet of a flue gas recircultion fan;

injecting a fuel for said burner into said first space;

injecting said fuel for said burner from said first space into said burner at said first location, said first location being adjacent but spaced apart from the outlet of said burner;

directing said minor portion from said recirculation fan and injecting said minor portion into said second space; and injecting said minor portion from said second space into said burner at a second location, said second location being downstream of said first location and being adjacent and spaced apart from said second location.

11. The invention set forth in claim 10 wherein slots are provided in said burner for the injection of said minor portion into said burner.

* * * * *